US011004418B2

(12) United States Patent
Chen

(10) Patent No.: US 11,004,418 B2
(45) Date of Patent: May 11, 2021

(54) DISPLAY PANEL DRIVING METHOD, DRIVING DEVICE, DISPLAY DEVICE AND NON-TRANSITORY COMPUTER READABLE MEDIUM

(71) Applicants: HKC Corporation Limited, Shenzhen (CN); Chongqing HKC Optoelectronics Technology Co., Ltd., Chongqing (CN)

(72) Inventor: Yu-Jen Chen, Chongqing (CN)

(73) Assignees: HKC Corporation Limited, Shenzhen (CN); Chongqing HKC Optoelectronics Technology Co., Ltd., Chongqing (CN)

( * ) Notice: Subject to any disclaimer, the term of this patent is extended or adjusted under 35 U.S.C. 154(b) by 0 days.

(21) Appl. No.: 16/622,646

(22) PCT Filed: Sep. 1, 2017

(86) PCT No.: PCT/CN2017/100257
§ 371 (c)(1),
(2) Date: Dec. 13, 2019

(87) PCT Pub. No.: WO2019/000636
PCT Pub. Date: Jan. 3, 2019

(65) Prior Publication Data

US 2020/0372872 A1 Nov. 26, 2020

(30) Foreign Application Priority Data

Jun. 29, 2017 (CN) ..... 201710516338.6

(51) Int. Cl.
*G09G 3/36* (2006.01)

(52) U.S. Cl.
CPC ..... *G09G 3/3677* (2013.01); *G09G 3/3688* (2013.01); *G09G 2310/0278* (2013.01);
(Continued)

(58) Field of Classification Search
CPC ..... G09G 3/3677; G09G 3/3688; G09G 2320/068; G09G 2310/0278; G09G 2320/0214
See application file for complete search history.

(56) References Cited

U.S. PATENT DOCUMENTS 9,240,152 B2 * 1/2016 Dong ..... G09G 3/3614
10,593,246 B2 * 3/2020 Tsai ..... G09G 3/20
(Continued)

FOREIGN PATENT DOCUMENTS

CN 101290411 A 10/2008
CN 102436105 A 5/2012
(Continued)

*Primary Examiner* — Grant Sitta
(74) *Attorney, Agent, or Firm* — Wang Law Firm, Inc.

(57) ABSTRACT

A driving method, a driving device, and a display device are provided. The driving method includes steps of: turning on the first and second switch transistors under control of the first scanning line and turning off the third switch transistor under control of the second scanning line and turning off the fourth switch transistor under control of the third scanning line to control the data line to input data signals into the first and the second pixel electrodes through the first and second switch transistors; turning on the third switch transistor and turning off the first and second switch transistors and turning off the fourth switch transistor to establish a preset voltage difference between the first and second pixel electrodes. Wherein, the first and second pixel electrodes, and the auxiliary electrode are made of a same material.

15 Claims, 9 Drawing Sheets

(52) U.S. Cl.
CPC ..... *G09G 2320/0214* (2013.01); *G09G 2320/068* (2013.01)

(56) References Cited

U.S. PATENT DOCUMENTS

2007/0064182 A1* 3/2007 Lin ..... G02F 1/13624 349/114
2007/0153146 A1* 7/2007 Shih ..... G02F 1/136 349/42
2008/0246720 A1* 10/2008 Lee ..... G09G 3/3614 345/96
2008/0284931 A1* 11/2008 Kimura ..... G09G 3/3655 349/39
2010/0220116 A1* 9/2010 Liao ..... G09G 3/3659 345/690
2011/0085105 A1* 4/2011 Park ..... G02F 1/1333 349/54
2011/0170029 A1* 7/2011 Kimura ..... G09G 3/3659 349/38
2011/0170031 A1* 7/2011 Son ..... H01L 27/1225 349/46
2011/0221988 A1* 9/2011 Cho ..... G02F 1/1395 349/41
2012/0026415 A1* 2/2012 Tsubata ..... G02F 1/136213 348/790
2012/0033148 A1* 2/2012 Yang ..... G02F 1/13624 349/39
2013/0249882 A1* 9/2013 Lin ..... G09G 3/36 345/212
2014/0035968 A1* 2/2014 Chen ..... G09G 3/003 345/691

FOREIGN PATENT DOCUMENTS

CN 102750899 A 10/2012
CN 103353698 A 10/2013

* cited by examiner

DISPLAY PANEL DRIVING METHOD, DRIVING DEVICE, DISPLAY DEVICE AND NON-TRANSITORY COMPUTER READABLE MEDIUM

CROSS-REFERENCE TO RELATED APPLICATION

The present application claims priority to China Patent Application No. 201710516338.6, filed on Jun. 29, 2017, titled "Driving method of display panel, driving device and display device", which is the international priority application of the present application, the entire content of which is incorporated in the present application by reference.

BACKGROUND

1. Field

The present disclosure relates to display technology area and especially relates to a driving method of display panels, a driving device, a display device and a non-transitory computer readable medium thereof.

2. Description of the Related Art

A typical problem related to liquid-crystal display panels is that they tend to have color shift problems, which becomes more pronounced in liquid-crystal panels of larger screen area and becomes much more obvious with screens of a larger viewing angle. In order to improve the viewing angle and, at the same time, reduce color shift of these display panels, each pixel unit in the liquid-crystal display panel is generally divided into a primary pixel electrode and a secondary pixel electrode, and a storage capacitor is also adopted and is electrically connected to the secondary pixel electrode through a switch transistor. In performing a plane display, the switch transistors that respectively connect with the primary pixel electrode and the secondary pixel electrode can be turned on through the control of a scanning line, and a data line inputs a data signal to the primary pixel electrode and the secondary pixel electrode, and, then, a switch transistor between the storage capacitor and the secondary pixel electrode is controlled to be turned on to electrically connect the secondary pixel electrode and the storage capacitor, and a portion of the charge on the secondary pixel electrode is released to the storage capacitor, such that a voltage difference is built up between the primary pixel electrode and the secondary pixel electrode differentiating the angles of liquid crystals, thereby reducing color shift. However, the electrodes of the storage capacitor are usually made of metal, and the adoption of the storage capacitor will occupy a portion of the pixel electrode area, thereby lowering the aperture ratio of the liquid-crystal display panels.

In addition, in performing a three-dimensional display, the pixel structures are in a bright state, in the case of normally-black type liquid-crystal display panels, have shorter distance between one and another, which narrows the viewing angle of the liquid-crystal display panel which has a three-dimensional display. Also, crosstalk incidents may also occur between these pixel structures.

SUMMARY

According to an embodiment, the present disclosure provides a driving method of a display panel. wherein the display panel comprises: a plurality of data lines; a plurality of first scanning lines; a plurality of second scanning lines; a plurality of third scanning lines; a plurality of common voltage signal lines; a plurality of the pixel units; a plurality of first switch transistors; a plurality of second switch transistors; a plurality of third switch transistors; and a plurality of fourth switch transistors. Wherein each of the pixel units includes a first pixel electrode, a second pixel electrode, and an auxiliary electrode made of a same material. The plurality of first switch transistors is disposed corresponding to the first pixel electrodes, wherein the control electrode of the first switch transistor is electrically connected to the first scanning line, and a first electrode of the first switch transistor is electrically connected to the data line, and a second electrode of the first switch transistor is electrically connected to a corresponding one of the first pixel electrodes. The plurality of second switch transistors is disposed corresponding to the second pixel electrodes, wherein the control electrode of the second switch transistor is electrically connected to the first scanning line, and a first electrode of the second switch transistor is electrically connected to the data line electrically connected by the first switch transistor, and a second electrode of the second switch transistor is electrically connected to a corresponding one of the second pixel electrodes. The plurality of third switch transistors is disposed corresponding to the auxiliary electrodes, wherein a control electrode of the third switch transistor is electrically connected to the second scanning line, and a first electrode of the third switch transistor is electrically connected to the second pixel electrode of a same one of the pixel units, and a second electrode of the third switch transistor is electrically connected to a corresponding one of the auxiliary electrodes. Wherein the control electrode of the fourth switch transistor is electrically connected to the third scanning line, and a first electrode of the fourth switch transistor is electrically connected to the common voltage signal line, and a second electrode of the fourth switch transistor is electrically connected to the auxiliary electrode. The driving method comprising: in performing a plane display, turning on the first switch transistor and the second switch transistor under control of the first scanning line and turning off the third switch transistor under control of the second scanning line and turning off the fourth switch transistor under control of the third scanning line to have the data line to input a data signal to the first pixel electrode and the second pixel electrode through the first switch transistor and the second switch transistor, thereby driving pixel structures where the first pixel electrode and the second pixel electrode are located to display; and turning on the third switch transistor under control of the second scanning line, such that the second pixel electrode is in conduction with the auxiliary electrode, and turning off the first switch transistor and the second switch transistor under control of the first scanning line and turning off the fourth switch transistor under control of the third scanning line, such that a portion of the charge in the second pixel electrode is transferred to the auxiliary electrode, thereby establishing a preset voltage difference between the first pixel electrode and the second pixel electrode.

According to an embodiment, the present disclosure also provides a driving device of a display panel, comprising: a driver module; and a voltage control module. The driver module is configured to, in performing a plane display, turn on a first switch transistor and a second switch transistor under control of a first scanning line and turn off a third switch transistor under control of a second scanning line and turn off a fourth switch transistor under control of a third scanning line, such that a data line inputs a data signal into a first pixel electrode and a second pixel electrode through the first switch transistor and the second switch transistor, thereby driving pixel structures where the first pixel electrode and the second pixel electrode are located to display. The voltage control module is configured to turn on the third switch transistor under control of the second scanning line, and turn off the first switch transistor and the second switch transistor under control of the first scanning line, and turn off the fourth switch transistor under control of the third scanning line, such that a portion of the charge in the second pixel electrode is transferred to an auxiliary electrode, thereby establishing a preset voltage difference between the first pixel electrode and the second pixel electrode. The display panel comprises an array substrate. The array substrate comprises: a plurality of the data lines; a plurality of the first scanning lines; a plurality of the second scanning lines; a plurality of the third scanning lines; a plurality of common voltage signal lines; a plurality of pixel units; a plurality of pixel units; a plurality of the first switch transistors; a plurality of the second switch transistors; a plurality of the third switch transistors; and a plurality of the fourth switch transistors. Wherein each of the pixel unit includes the first pixel electrode, the second pixel electrode, and the auxiliary electrode made of a same material. The plurality of the first switch transistors is disposed corresponding to the first pixel electrodes, wherein the control electrode of the first switch transistor is electrically connected to the first scanning line, and a first electrode of the first switch transistor is electrically connected to the data line, and a second electrode of the first switch transistor is electrically connected to a corresponding one of the first pixel electrodes. The plurality of the second switch transistors is disposed corresponding to the second pixel electrodes, wherein the control electrode of the second switch transistor is electrically connected to the first scanning line, and a first electrode of the second switch transistor is electrically connected to the data line that is electrically connected to the first switch transistor, and a second electrode of the second switch transistor is electrically connected to a corresponding one of the second pixel electrodes. The plurality of the third switch transistors is disposed corresponding to the auxiliary electrodes, wherein the control electrode of the third switch transistor is electrically connected to the second scanning line, and a first electrode of the third switch transistor is electrically connected to the second pixel electrode of a same one of the pixel units, and a second electrode of the third switch transistor is electrically connected to a corresponding one of the auxiliary electrodes. Wherein the control electrode of the fourth switch transistor is electrically connected to the third scanning line, and a first electrode of the fourth switch transistor is electrically connected to the common voltage signal line, and a second electrode of the fourth switch transistor is electrically connected to the auxiliary electrode.

According to an embodiment, the present disclosure also provides a driving device of a display panel, comprising: a driver module and a voltage control module. The driver module is configured to, in performing a plane display, turn on a first switch transistor and a second switch transistor under control of a first scanning line and turn off a third switch transistor under control of a second scanning line, and turn off a fourth switch transistor under control of a third scanning line, such that a data line inputs a data signal into a first pixel electrode and a second pixel electrode through the first switch transistor and the second switch transistor, thereby driving pixel structures where the first pixel electrode and the second pixel electrode are located to display. The voltage control module is configured to turn on the third switch transistor under control of the second scanning line and turn off the first switch transistor and the second switch transistor under control of the first scanning line and turn off the fourth switch transistor under control of the third scanning line, such that a portion of the charge in the second pixel electrode is transferred to an auxiliary electrode, thereby establishing a preset voltage difference between the first pixel electrode and the second pixel electrode. The display panel comprises an array substrate. The array substrate comprises: a plurality of the data lines; a plurality of the first scanning lines; a plurality of the second scanning lines; a plurality of the third scanning lines; a plurality of common voltage signal lines; a plurality of pixel units; a plurality of the first switch transistors; a plurality of the second switch transistors; a plurality of the third switch transistors; and a plurality of the fourth switch transistors. Wherein each of the pixel units includes the first pixel electrode, the second pixel electrode, and the auxiliary electrode made of a same material. The plurality of the first switch transistors is disposed corresponding to the first pixel electrodes, wherein the control electrode of the first switch transistor is electrically connected to the first scanning line, and a first electrode of the first switch transistor is electrically connected to the data line, and a second electrode of the first switch transistor is electrically connected to a corresponding one of the first pixel electrodes. The plurality of the second switch transistors is disposed corresponding to the second pixel electrodes, wherein the control electrode of the second switch transistor is electrically connected to the first scanning line, and a first electrode of the second switch transistor is electrically connected to the data line electrically connected by the first switch transistor, and a second electrode of the second switch transistor is electrically connected to a corresponding one of the second pixel electrodes. The plurality of the third switch transistors is disposed corresponding to the auxiliary electrodes, wherein the control electrode of the third switch transistor is electrically connected to the second scanning line, and a first electrode of the third switch transistor is electrically connected to the second pixel electrode of a same one of the pixel units, and a second electrode of the third switch transistor is electrically connected to a corresponding one of the auxiliary electrodes. Wherein the control electrode of the fourth switch transistor is electrically connected to the third scanning line, and a first electrode of the fourth switch transistor is electrically connected to the common voltage signal line, and a second electrode of the fourth switch transistor is electrically connected to the auxiliary electrode. Wherein the first switch transistor, the second switch transistor, the third switch transistor, and the fourth switch transistor are thin film transistors.

DESCRIPTION OF THE PREFERRED EMBODIMENTS

Figure 1:
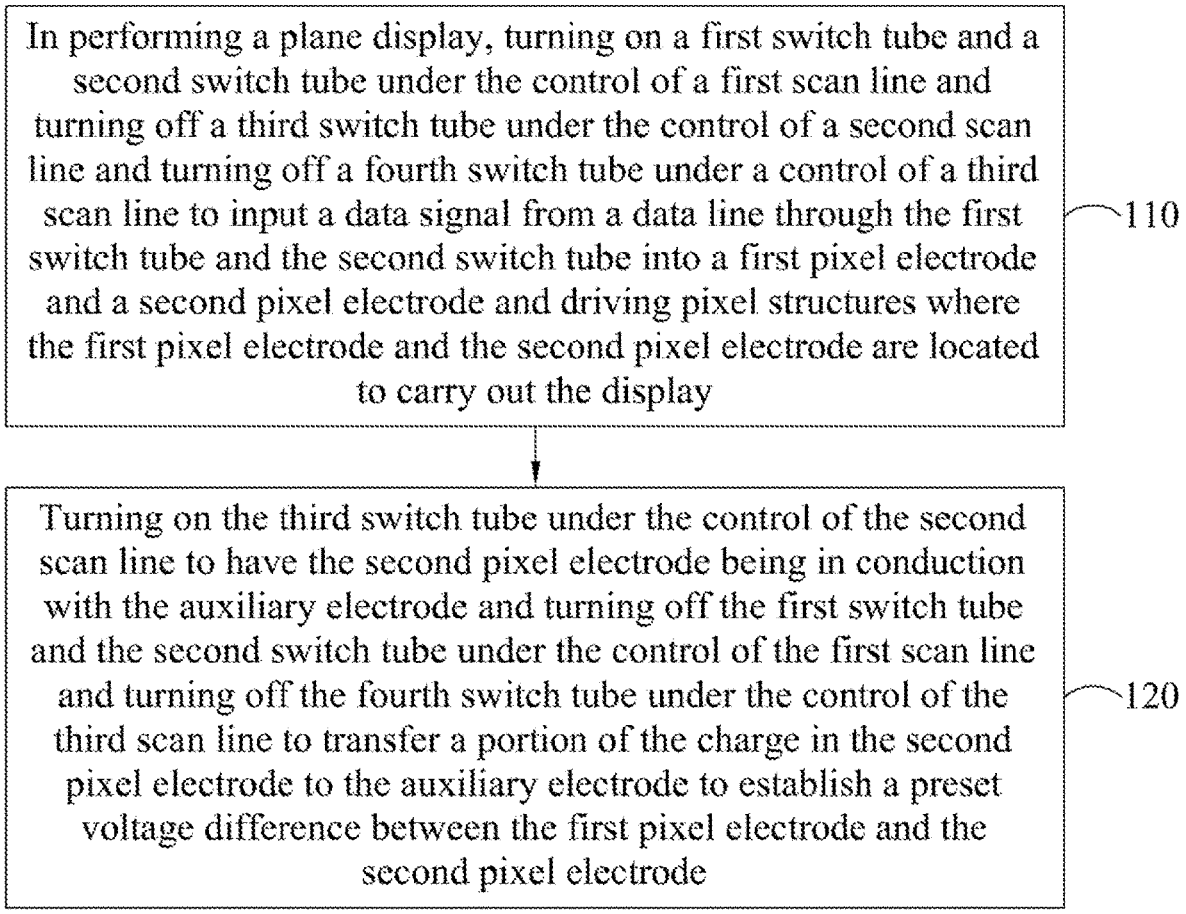
FIG. 1 is a schematic diagram showing a flow chart of a driving method of a display panel provided in the present embodiment.

FIG. 1 is a schematic diagram showing a flow chart of a driving method of a display panel provided in the present embodiment, wherein the driving method is applicable on a situation that requires driving the display panel to carry out a plane display.

The method includes a step 110 of, in performing a plane display, turning on a first switch transistor and a second switch transistor under control of a first scanning line and turning off a third switch transistor under control of a second scanning line and turning off a fourth switch transistor under control of a third scanning line to input a data signal from a data line through the first switch transistor and the second switch transistor into a first pixel electrode and a second pixel electrode, thereby driving pixel structures where the first pixel electrode and the second pixel electrode are located to display.

Figure 2:
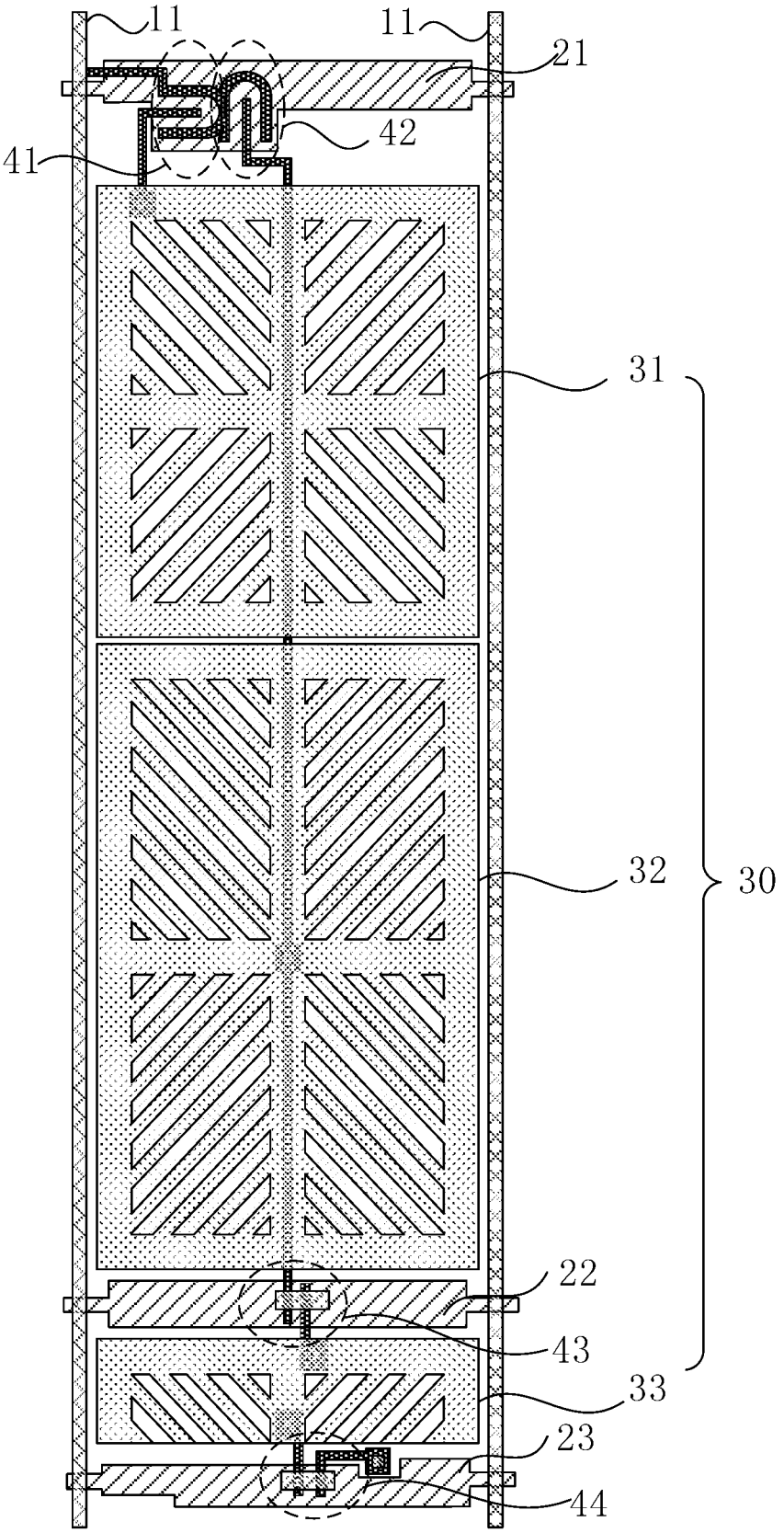
FIG. 2 is a schematic diagram showing a top view of an array substrate structure provided in the present embodiment.
Figure 3:
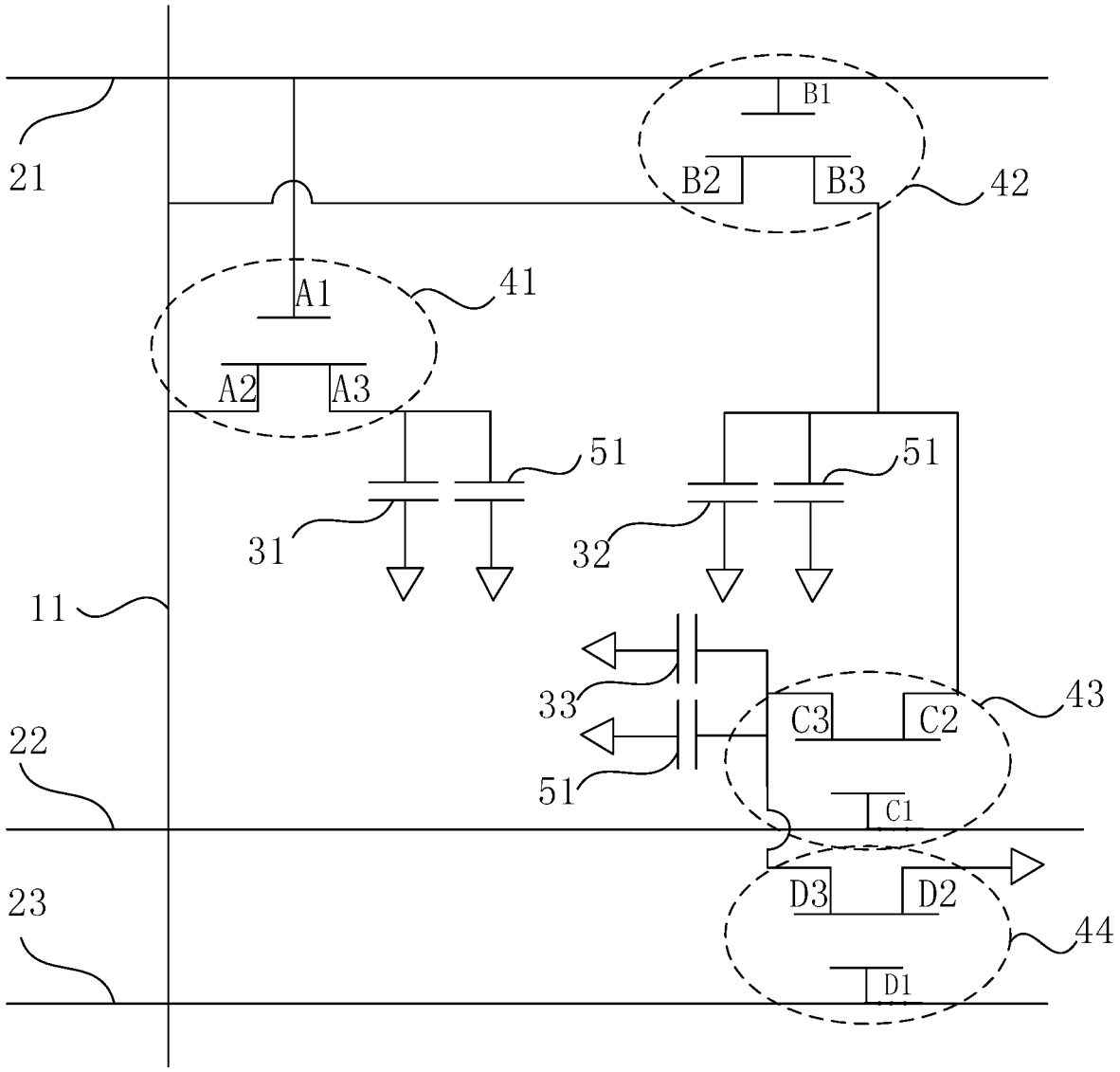
FIG. 3 is an equivalent schematic diagram of a pixel unit in an array substrate provided in the present embodiment.

FIG. 2 is a schematic diagram showing an array substrate structure provided in the present embodiment, and FIG. 3 is an equivalent circuit diagram of a pixel unit in an array substrate provided in the present embodiment. In combination of FIG. 2 and FIG. 3, the array substrate includes a plurality of data lines 11, a plurality of first scanning lines 21, a plurality of second scanning lines 22, a plurality of third scanning lines 23, a plurality of common voltage signal lines 24, a plurality of pixel units 30, a plurality of first switch transistors 41, a plurality of second switch transistors 42, a plurality of third switch transistors 43, and a plurality of fourth switch transistors 44.

Wherein, every pixel unit 30 includes a first pixel electrode 31, a second pixel electrode 32, and an auxiliary electrode 33 made of a same material. The first switch transistor 41 and the first pixel electrode 31 are correspondingly disposed, and the control electrode A1 of the first switch transistor 41 is electrically connected to the first scanning line 21, and a first electrode A2 is electrically connected to the data line 11, and a second electrode A3 is electrically connected to the corresponding first pixel electrode 31. The second switch transistor 42 and the second pixel electrode 32 are correspondingly disposed, and the control electrode B1 of the second switch transistor 42 is electrically connected to the first scanning line 21, and a first electrode B2 is electrically connected to the data line 11 electrically connected by the first switch transistor 41, and a second electrode B3 is electrically connected to the corresponding second pixel electrode 32. The third switch transistor 43 and the auxiliary electrode 33 are correspondingly disposed, and the control electrode C1 of the third switch transistor 43 is electrically connected to the second scanning line 22, and a first electrode C2 is electrically connected to the second pixel electrode 32 located in the same pixel unit 30, and a second electrode C3 is electrically connected to the corresponding auxiliary electrode 33. The control electrode D1 of the fourth switch transistor 44 is electrically connected to the third scanning line 23, and a first electrode D2 is electrically connected to the common voltage signal line 24, and a second electrode D3 is electrically connected to the auxiliary electrode 33.

In performing a plane display, the first switch transistor 41 and the second switch transistor 42 can be turned on under control of the first scanning line 21, and the third switch transistor 43 can be turned off under control of the second scanning line 22, and the fourth switch transistor 44 can be turned off under control of the third scanning line 23, and the data line 11 can input a data signal into the first pixel electrode 31 and the second pixel electrode 32, and, at the same moment, the pixel structures where the first electrode 31 and the second pixel electrode 31 are located carry out the display, and the first pixel electrode 31 and the second pixel electrode 32 have the same voltage.

The method includes a step 120 of turning on the third switch transistor under control of the second scanning line to have the second pixel electrode being in conduction with the auxiliary electrode and turning off the first switch transistor and the second switch transistor under control of the first scanning line and turning off the fourth switch transistor under control of the third scanning line to transfer a portion of the charge in the second pixel electrode to the auxiliary electrode to establish a preset voltage difference between the first pixel electrode and the second pixel electrode.

In combination of FIG. 2 and FIG. 3, the third switch transistor 43 can be turned on under control of the second scanning line 22, and the first switch transistor 41 and the second switch transistor 42 can be turned off under control of the first scanning line 21, and the fourth switch transistor 44 can be turned off under control of the third scanning line 23, and, therefore, a portion of the charge on the second pixel electrode 32 can be released to the auxiliary electrode 33 through the third switch transistor 43, and a voltage difference is built up between the first pixel electrode 31 and the second pixel electrode 32 causing a tilt angle difference between the liquid-crystal molecules disposed corresponding to the first pixel electrode 31 and the liquid-crystal molecules disposed corresponding to the second pixel electrode 32, thereby improving viewing angle and reducing color shift of the liquid-crystal display panel. Also, because the auxiliary electrode 33, the first pixel electrode 31, and the second pixel electrode 32 are made of a same material, which may exemplarily include indium tin oxide material, the existing lowered aperture ratio problem of liquid-crystal display panels in relating technologies may be solved, which means the adoption of the auxiliary electrode 33 reduces color shift of the liquid-crystal display panel and also improves aperture ratio of the liquid-crystal display panel.

Figure 4:
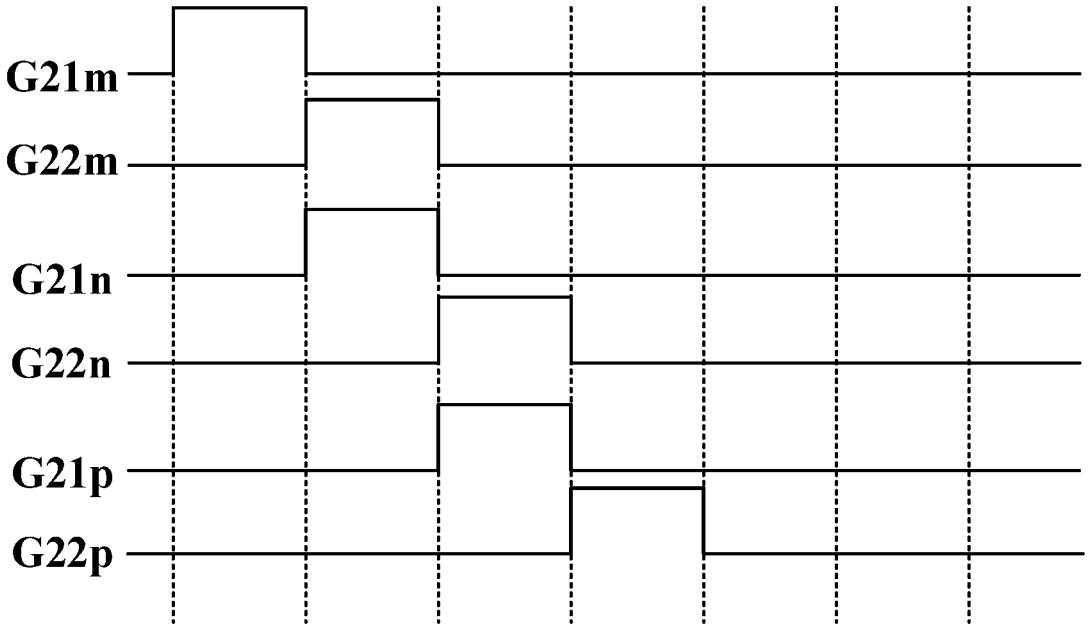
FIG. 4 is a timing diagram of the driving method shown in FIG. 1.

FIG. 4 is an exemplary timing diagram of the driving method shown in FIG. 1. In combination of FIGS. 2-4, G21*m*, G21*n* and G21*p* are scanning signals respectively on three arbitrary first scanning lines 21 of the display panel, and G22*m*, G22*n*, and G22*p* are scanning signals respectively on three second scanning lines 22 corresponding to said three first scanning lines. In performing a two dimensional display, a forward-scanning mode is adopted, referring to FIG. 4, which means high voltage level pulses in the scanning signals G22*m*, G22*n*, and G22*p* on the second scanning line 22 travel behind high voltage level pulses in the scanning signals G21*m*, G21*n* and G21*p* on the first scanning line 21, achieving the preset voltage difference established between the first pixel electrode 31 and the second pixel electrode 32 through the auxiliary electrode 33 and, therefore, solving the color shift problem of the display panel.

The third switch transistor 43 is turned on under control of the second scanning line 22, and the first switch transistor 41 and the second switch transistor 42 are turned off under control of the first scanning line 21, and the fourth switch transistor 44 is turned off under control of the third scanning line 23, and, therefore, a portion of the charge on the second pixel electrode 32 can be released to the auxiliary electrode 33 through the third switch transistor 43 to build up the preset voltage difference between the first pixel electrode 31 and the second pixel electrode 32, which means the liquid crystal molecules corresponding to the first pixel electrode 31 and the liquid crystal molecules corresponding to the second pixel electrode 32 have a different deflected angle, thereby increasing the viewing angle and reducing the color shift of the liquid-crystal display panel in performing the plane display.

Figure 5:
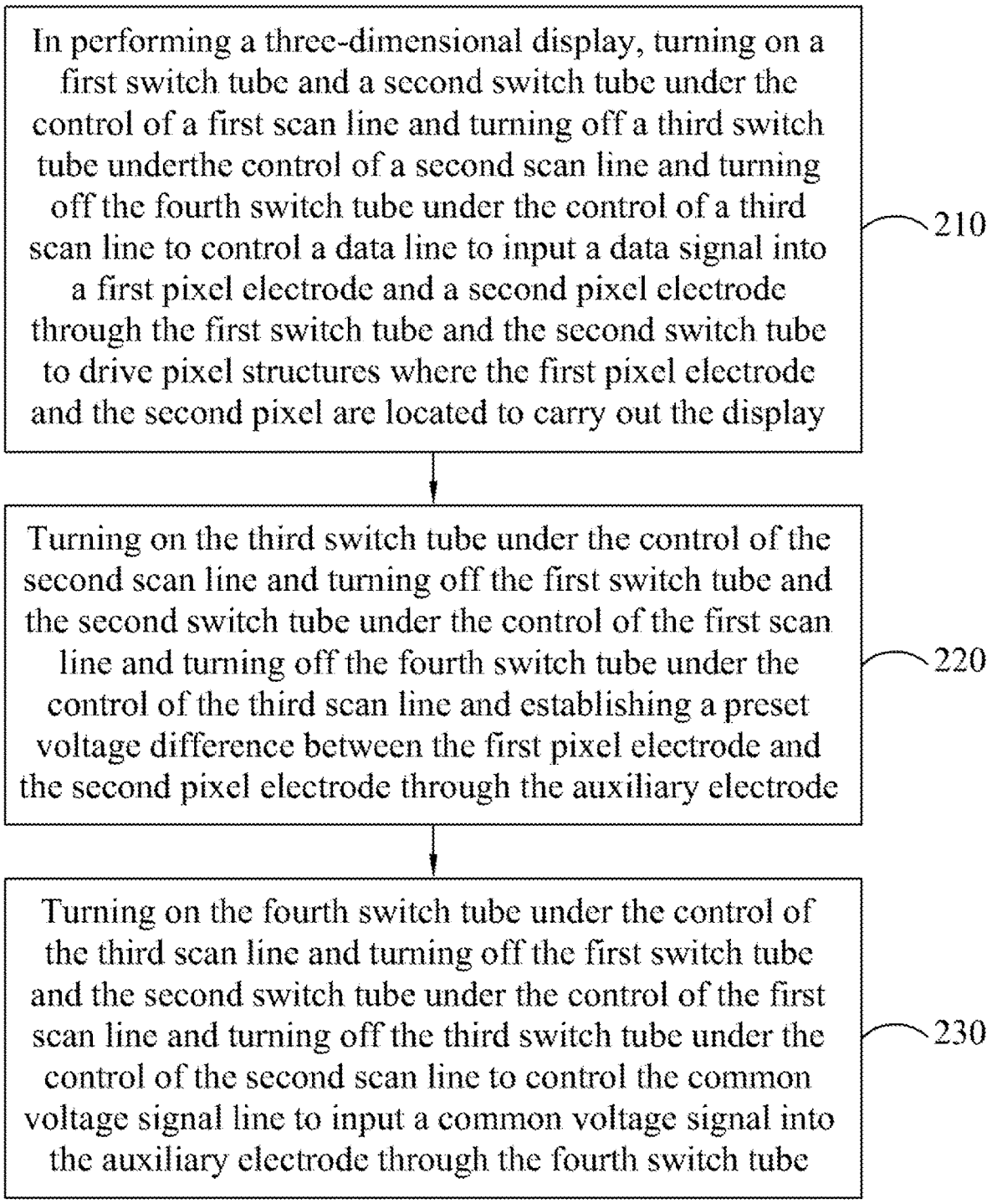
FIG. 5 is a schematic diagram showing a flow chart of another driving method of a display panel provided in the present embodiment.

FIG. 5 is a schematic diagram showing a flow chart of another driving method of a display panel provided in the present embodiment. The driving method is applicable on a situation that requires driving a display panel to carry out a three dimensional display.

The method includes a step 210 of, in performing a three dimensional display, turning on a first switch transistor and a second switch transistor under control of a first scanning line and turning off a third switch transistor under control of a second scanning line and turning off the fourth switch transistor under control of a third scanning line to control a data line to input a data signal into a first pixel electrode and a second pixel electrode through the first switch transistor and the second switch transistor to drive pixel structures where the first pixel electrode and the second pixel are located to carry out the display.

Figure 6:
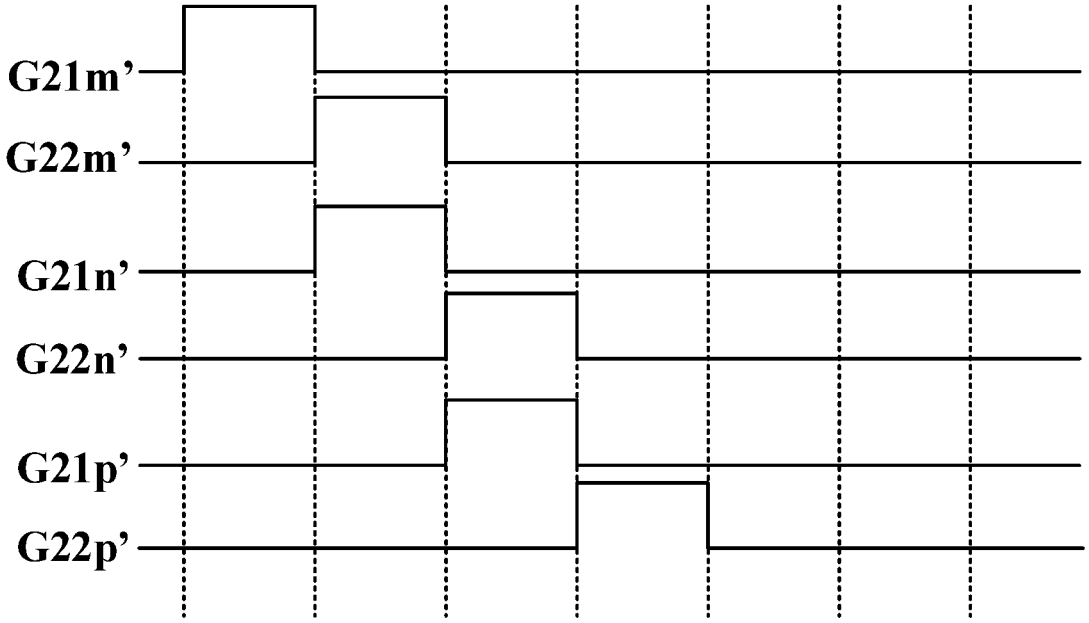
FIG. 6 is a timing diagram of the driving method shown in FIG. 5.

FIG. 6 is a timing diagram of the driving method shown in FIG. 5, wherein G21*m*', G21*n*', and G21*p*' are respective scanning signals on three arbitrary first scanning lines 21 of the display panel, and G22*m*', G22*n*', and G22*p*' are respective scanning signals on the second scanning lines 22 corresponding to the mentioned three first scanning lines, and, being the same as the drive timing sequence in the two dimensional display, the scanning manner follows the same principles as in plane display and will not be reiterated.

In combination of FIG. 2 and FIG. 3, when the liquid-crystal display panel is performing a display, the data line 11 is electrically connected to the pixel electrode provides a data signal to the corresponding pixel electrode, and, while a common electrode has the common voltage signal at the moment, liquid crystal molecules are deflected under an electric field created between the pixel electrode and the common electrode, thereby carrying out the display function of the liquid-crystal display panel. It should be noted that the liquid-crystal display panel can be of a normally-white type or a normally-black type. In the case of the normally-white liquid-crystal display panels, when there is an electric field between the pixel electrode and the common electrode, the liquid crystal molecules have alignment directions the same as the direction of the electric field and do not optically rotate light. In the normally-white liquid-crystal display panels, the polarizers on each side of the liquid crystals have polarization transmitting directions orthogonal to one and the other, and the pixel structure where the pixel electrode is located is in its dark state; when there is no electric field between the pixel electrode and the common electrode, the pixel structure where the pixel electrode is located is in its bright state. In the case of the normally-black liquid-crystal display panels, the polarizers on each side of the liquid crystals have polarization transmitting directions parallel to one and the other, and, thus, when there is an electric field between the pixel electrode and the common electrode, the pixel structure where the pixel electrode is located is in its bright state; when there is no electric field between the pixel electrode and the common electrode, the pixel structure where the pixel electrode is located is in its dark state. Although the liquid-crystal display panel in the present embodiment is not limited to a normally-black or normally-white type liquid-crystal display panel, the following will be set forth in the case of a normally-black liquid-crystal display panel for facilitating the description, but one skilled in the art should construe that the bright state and the dark state of a pixel structure mentioned in the present embodiment are only relative to one and the other.

The first switch transistor 41 and the second switch transistor 42 can be turned on under control of the first scanning line 21, and the third switch transistor 43 can be turned off under control of the second scanning line 22, and the fourth switch transistor 44 can be turned off under control of the third scanning line 23, and the data line 11 inputs a data signal into the first pixel electrode 31 and the second pixel electrode 32 through the first switch transistor 41 and the second switch transistor 42, and, therefore, the pixel structures where the first pixel electrode 31 and the second pixel electrode 32 locate are in their bright state.

The method includes a step 220 of turning on the third switch transistor under control of the second scanning line and turning off the first switch transistor and the second switch transistor under control of the first scanning line and turning off the fourth switch transistor under control of the third scanning line and establish a preset voltage difference between the first pixel electrode and the second pixel electrode through the auxiliary electrode.

In combination of FIG. 2 and FIG. 3, the third switch transistor 43 is turned on under control of the second scanning line 22, and the first switch transistor 41 and the second switch transistor 42 are turned off under control of the first scanning line 21, and the fourth switch transistor 44 is turned off under control of the third scanning line 23, and the preset voltage difference is established between the first pixel electrode 31 and the second pixel electrode 32 causing a tilt angle difference between the liquid-crystal molecules corresponding to the first pixel electrode 31 and the liquid-crystal molecules corresponding to the second pixel electrode 32, thereby improving viewing angle of the liquid-crystal display panel and reducing color shift.

The method includes a step 230 of turning on the fourth switch transistor under control of the third scanning line and turning off the first switch transistor and the second switch transistor under control of the first scanning line and turning off the third switch transistor under control of the second scanning line to control the common voltage signal line to input a common voltage signal into the auxiliary electrode through the fourth switch transistor.

In combination of FIG. 2 and FIG. 3, the fourth switch transistor 44 can be turned on under control of the third scanning line 23, and the first switch transistor 41 and the second switch transistor 42 can be turned off under control of the first scanning line 21, and the third switch transistor 43 can be turned off under control of the second scanning line 22, and the common voltage signal line 24 inputs the common voltage signal into the auxiliary electrode 33 through the fourth switch transistor 44, and, therefore, the auxiliary electrode 33 and the common electrode both carry the common voltage signal and have no voltage difference between them, which means the electric field that controls the deflection of the liquid crystal molecules between the common electrode, such that the auxiliary electrode 33 can not be created, and the pixel structure where the auxiliary electrode 33 is located is in its dark state at the moment.

Optionally, as shown in FIG. 2, the first pixel electrode 31, the second pixel electrode 32, and the auxiliary electrode 33 can be sequentially disposed along a direction in parallel to the data line 11, and the projections of the second scanning line 22 and the third switch transistor 43 on the layer where the second pixel electrode 32 and the auxiliary electrode 33 are disposed can be positioned between the second pixel electrode 32 and the auxiliary electrode 33. As the pixel structures where the first pixel electrode 31 and the second pixel electrode 32 are located being in their bright state and the pixel structure where the auxiliary electrode 33 are located being in its dark state, the bright state pixel structures are separated by the dark state pixel structure along the direction in parallel to the data line 11 so as to increase the distance between the bright state pixel structures, thereby increasing viewing angle of the liquid-crystal display panel in performing a three dimensional display and reducing crosstalk incidents caused by the short distance between the pixel electrodes located in pixel structures.

Optionally, the first switch transistor 41, the second switch transistor 42, the third switch transistor 43, and the fourth switch transistor 44 can be thin film transistors, wherein the control electrode A1 of the first switch transistor 41 is a gate electrode of the thin film transistor, and the first electrode A2 of the first switch transistor 41 is a drain electrode of the thin film transistor, and the second electrode A3 of the first switch transistor 41 is a source electrode of the thin film transistor. The control electrode B1 of the second switch transistor 42 is a gate electrode of the thin film transistor and the first electrode B2 of the second switch transistor 42 is a drain electrode of the thin film transistor, and the second electrode B3 of the second switch transistor 42 is a source electrode of the thin film transistor. The control electrode C1 of the third switch transistor 43 is a gate electrode of the thin film transistor, and the first electrode C2 of the third switch transistor 43 is a drain electrode of the thin film transistor, and the second electrode C3 of the third switch transistor 43 is a source electrode of the thin film transistor. The control electrode D1 of the fourth switch transistor 44 is a gate electrode of the thin film transistor, and the first electrode D2 of the fourth switch transistor 44 is a drain electrode of the thin film transistor, and the second electrode D3 of the fourth switch transistor 44 is a source electrode of the thin film transistor.

Optionally, the first pixel electrode 31, the second pixel electrode 32, and the auxiliary electrode 33 may, as shown in FIG. 3, each connects in parallel to at least one storage capacitor 51 located within a non-display area of the liquid-crystal display panel. FIG. 3 exemplarily shows the first pixel electrode 31, the second pixel electrode 32, and the auxiliary electrode 33 each connecting in parallel to the storage capacitor 51 respectively, and the adopted storage capacitors 51 can effectively avoid a voltage fluctuation on the first pixel electrode 31, the second pixel electrode 32, and the auxiliary electrode 33 to ensure working stability of the first pixel electrode 31, the second pixel electrode 32, and the auxiliary electrode 33. Disposing the capacitors 51 connecting in parallel to the first pixel electrode 31, the second pixel electrode 32, and the auxiliary electrode 33 within the non-display area of the liquid-crystal display panel can also avoid the impact of the storage capacitors 51 on the aperture ratio of the liquid-crystal display panel.

Figure 7:
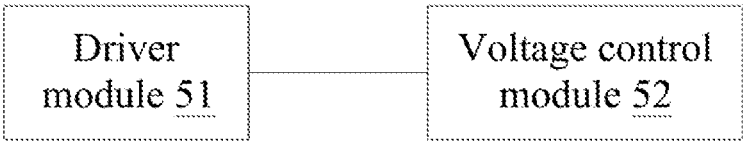
FIG. 7 is a schematic diagram showing a driving device structure of a display panel provided in the present embodiment.

FIG. 7 is a schematic diagram showing a driving device structure of a display panel provided in the present embodiment. As shown in FIG. 7, the driving device of the display panel includes a driver module 51 and a voltage control module 52, and, in performing a plane display, the driver module 51 is configured to turn on a first switch transistor and a second switch transistor under control of a first scanning line and to turn off a third switch transistor under control of a second scanning line and to turn off a fourth switch transistor under control of a third scanning line so as to control a data line to input a data signal into a first pixel electrode and a second pixel electrode through the first switch transistor and the second switch transistor to drive pixel structures where the first pixel electrode and the second pixel electrode is located to carry out the display; the voltage control module 52 is configured to turn on the third switch transistor under control of the second scanning line and turn off the first switch transistor and the second switch transistor under control of the first scanning line and to turn off the fourth switch transistor under control of the third scanning line to have a portion of the charge in the second pixel electrode being transferred to an auxiliary electrode so as to establish a preset voltage difference between the first pixel electrode and the second pixel electrode.

The display panel includes an array substrate and also a color-filter substrate disposed opposite to the array substrate. The array substrate includes a plurality of data lines, a plurality of first scanning lines, a plurality of second scanning lines, a plurality of third scanning lines, a plurality of common voltage signal lines, a plurality of pixel units, a plurality of first switch transistors, a plurality of second switch transistors, a plurality of third switch transistors, and a plurality of fourth switch transistors. Each pixel unit includes a first pixel electrode, a second pixel electrode, and an auxiliary electrode made of a same material; the first switch transistor is arranged corresponding to the first pixel electrode, and the control electrode of the first switch transistor is electrically connected to the first scanning line, and a first electrode of the first switch transistor is electrically connected to one of the data lines, and a second electrode of the first switch transistor is electrically connected to a corresponding one of the first pixel electrodes; the second switch transistor is arranged corresponding to the second pixel electrode, and the control electrode of the second switch transistor is electrically connected to the first scanning line, and a first electrode of the second switch transistor is electrically connected to the data line that is electrically connected to the first switch transistor, and a second electrode of the second switch transistor is electrically connected to a corresponding one of the second pixel electrodes; the third switch transistor is arranged corresponding to the auxiliary electrode, and the control electrode of the third switch transistor is electrically connected to the second scanning line, and a first electrode of the third switch transistor is electrically connected to the second pixel electrode in same pixel unit, and a second electrode of the third switch transistor is electrically connected to a corresponding one of the auxiliary electrodes; the control electrode of the fourth switch transistor is electrically connected to the third scanning line, and a first electrode of the fourth switch transistor electrically connects the common voltage signal line, and a second electrode of the fourth switch transistor is electrically connected to the auxiliary electrode. A portion of the charge on the second pixel electrode can be stored on the auxiliary electrode to establish the voltage difference between the first pixel electrode and the second pixel electrode, thereby fulfilling the purpose of reducing color shift, and the auxiliary electrode can be made of a same material as the first and the second pixel electrodes, thereby also avoiding the impact of the auxiliary electrode on aperture ratio of the liquid-crystal display panel. Also, the use of the fourth switch transistor to introduce the common voltage signal into the auxiliary electrode improves the viewing angle of the liquid-crystal display panel in performing a three-dimensional display and reducing crosstalk between pixel structures where different electrodes are located.

Figure 8:
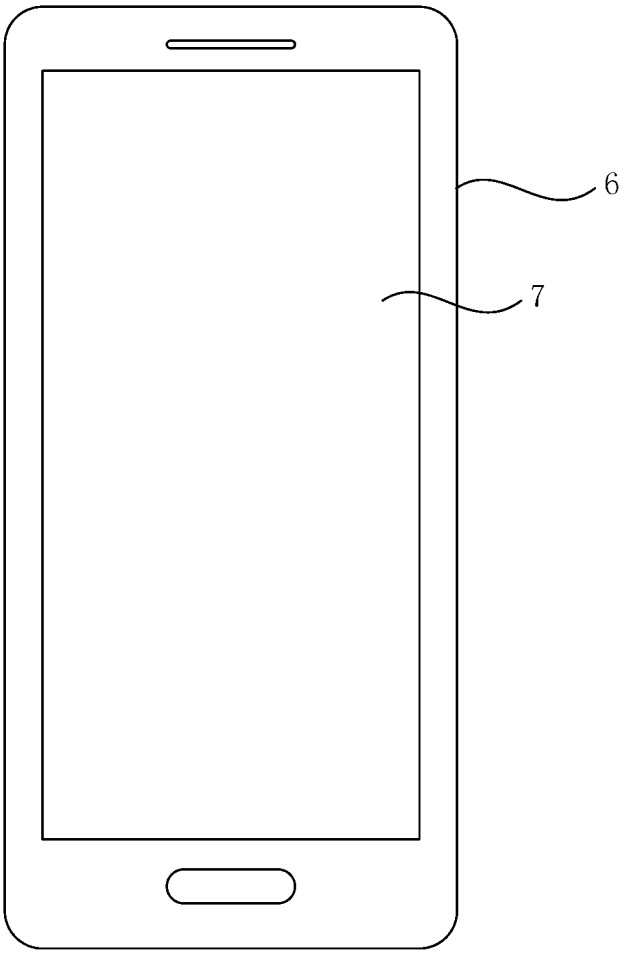
FIG. 8 is a schematic diagram showing a structure of a display device provided in the present embodiment.

On the basis of the aforementioned embodiments, FIG. 8 is a schematic diagram showing a structure of a display device provided in the present embodiment. As shown in FIG. 8, the display device 6 includes a display panel 7 and a driving device (not shown in the figure) and, as the driving device of the display panel in the aforementioned embodiment, has the same beneficial effects, which will not be reiterated. Exemplarily, the display device 6 can be, but not limited to, twisted nematic (TN) type, optically compensated birefringence (OCB), vertical alignment (VA) type, or curved type liquid-crystal display panel. The liquid-crystal display device can adopt direct back-lit type backlight, and the backlight source can be, but not limited to, white light, red-green-blue (RGB) three-color light, red-green-blue-white (RGBW) four-color light, or red-green-blue-yellow (RGBY) four-color light.

In performing a plane display in the present embodiment, the first switch transistor and the second switch transistor are turned on under control of the first scanning line, and the third switch transistor is turned off under control of the second scanning line, and the fourth switch transistor is turned off under control of the third scanning line, and the data line is controlled to input a data signal into the first pixel electrode and the second pixel electrode through the first switch transistor and the second switch transistor, and the pixel structures where the first pixel electrode and the second pixel electrode is located are driven to carry out the display; the third switch transistor is turned on under control of the second scanning line, and the first switch transistor and the second switch transistor are turned off under control of the first scanning line, and the fourth switch transistor is turned off under control of the third scanning line, and the preset voltage difference is controlled to be established between the first pixel electrode and the second pixel through the auxiliary electrode, wherein the first pixel electrode, the second pixel electrode, and the auxiliary electrode are arranged to be made of a same material. A portion of the charge on the second pixel electrode can be stored on the auxiliary electrode to establish the voltage difference between the first pixel electrode and the second pixel electrode, thereby fulfilling the purpose of reducing color shift, and the auxiliary electrode can be made of a same material as the first and the second pixel electrodes, thereby also avoiding the impact of the auxiliary electrode on the aperture ratio of the liquid-crystal display panel. Also, the use of the fourth switch transistor to introduce the common voltage signal into the auxiliary electrode improving viewing angle of the liquid-crystal display panel in performing a three-dimensional display and reducing crosstalk between pixel structures where different electrodes are located.

The present embodiment also provides a computer readable storage medium, storing computer executable instructions for carrying out any one of the aforementioned driving methods.

Figure 9:
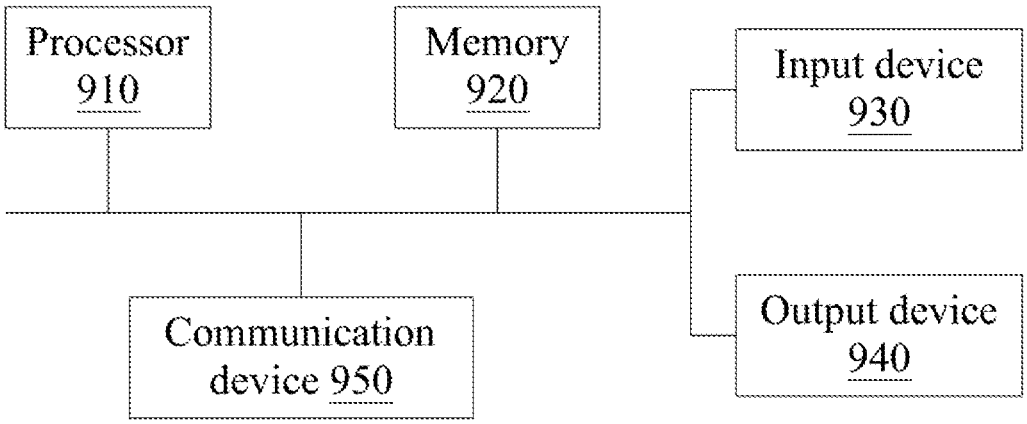
FIG. 9 is a schematic diagram showing a hardware structure of an electronic equipment provided in the present embodiment.

As shown in FIG. 9, which is a schematic diagram showing a hardware structure of an electronic equipment provided in the present embodiment, the electronic equipment includes one or more processors 910 and a memory 920. One processor 910 is used as an example in FIG. 9.

The electronic equipment may further include an input device 930 and an output device 940.

The processor 910, the memory 920, the input device 930, and the output device 940 of the electronic equipment can be coupled through a bus, as an example shown in FIG. 9, or by any other means.

The input device 930 can accept inputted digit or character information, and the output device 940 can include a display device such as a display panel.

The memory 920, as a computer readable storage medium, can store software programs, computer executable programs, and modules. The processor 910 runs the software programs, instructions, and modules stored in the memory 920 so as to carry out multiple functional applications and process data, thereby enforcing any methods in the aforementioned embodiments.

The memory 920 can include a program storage area and a data storage area, wherein the program storage area can store an operation system and at least one required function application, and the data storage area can store generated data based on the usage of the electronic equipment. In addition, the memory can include a volatile memory such as a random access memory (RAM), and the memory can also include a nonvolatile memory such as at least one magnetic disk memory, a flash memory, or any other non-transitory solid-state memories.

The memory 920 can be a non-transitory computer storage medium or a transitory computer storage medium. The non-transitory computer storage medium can be, for example, at least one magnetic disk memory, a flash memory, or any other nonvolatile solid-state memories. In some embodiments, the memory 920 can optionally include memories remote to the processor 910, and these remote storage memories can connect to the electronic equipment via a network. The network can practically include internet, a corporate Intranet, a local area network, a mobile communication network, or a combination thereof.

The input device 930 can be used to accept inputted digit or character information and generates key signal inputs related to user configurations and functional controls of the electronic equipment. The output device 940 can include a display device such as a display panel.

The electronic equipment of the present embodiment can further include a communication device 950 transmitting and/or receiving information via communication network.

One with ordinary skills in the art can understand that the procedures in the methods of the aforementioned embodiments can be fully or partially accomplished by hardware operations commanded by computer programs, which can be stored in a non-transitory computer readable storage medium, and when being executed, the programs can include the procedures such as those mentioned in the methods of the embodiments, wherein the non-transitory computer readable storage medium can be a magnetic disc, an optical disk, a read-only memory (ROM), or a random access memory (RAM).

What is claimed is:

1. A driving method of a display panel, wherein the display panel comprises:

a plurality of data lines;

a plurality of first scanning lines;

a plurality of second scanning lines;

a plurality of third scanning lines;

a plurality of common voltage signal lines;

a plurality of the pixel units, wherein each of the pixel units includes a first pixel electrode, a second pixel electrode, and an auxiliary electrode made of a same material;

a plurality of first switch transistors disposed corresponding to the first pixel electrodes, wherein the control electrode of the first switch transistor is electrically connected to the first scanning line, and a first electrode of the first switch transistor is electrically connected to the data line, and a second electrode of the first switch transistor is electrically connected to a corresponding one of the first pixel electrodes;

a plurality of second switch transistors disposed corresponding to the second pixel electrodes, wherein the control electrode of the second switch transistor is electrically connected to the first scanning line, and a first electrode of the second switch transistor is electrically connected to the data line electrically connected by the first switch transistor, and a second electrode of the second switch transistor is electrically connected to a corresponding one of the second pixel electrodes;

a plurality of third switch transistors disposed corresponding to the auxiliary electrodes, wherein a control electrode of the third switch transistor is electrically connected to the second scanning line, and a first electrode of the third switch transistor is electrically connected to the second pixel electrode of a same one of the pixel units, and a second electrode of the third switch transistor is electrically connected to a corresponding one of the auxiliary electrodes; and a plurality of fourth switch transistors, wherein the control electrode of the fourth switch transistor is electrically connected to the third scanning line, and a first electrode of the fourth switch transistor is electrically connected to the common voltage signal line, and a second electrode of the fourth switch transistor is electrically connected to the auxiliary electrode;

the driving method comprising:

in performing a plane display, turning on the first switch transistor and the second switch transistor under control of the first scanning line and turning off the third switch transistor under control of the second scanning line and turning off the fourth switch transistor under control of the third scanning line to have the data line to input a data signal to the first pixel electrode and the second pixel electrode through the first switch transistor and the second switch transistor, thereby driving pixel structures where the first pixel electrode and the second pixel electrode are located to display; and turning on the third switch transistor under control of the second scanning line, such that the second pixel electrode is in conduction with the auxiliary electrode, and turning off the first switch transistor and the second switch transistor under control of the first scanning line and turning off the fourth switch transistor under control of the third scanning line, such that a portion of the charge in the second pixel electrode is transferred to the auxiliary electrode, thereby establishing a preset voltage difference between the first pixel electrode and the second pixel electrode;

wherein, in performing a three dimensional display, turning on the first switch transistor and the second switch transistor under control of the first scanning line, turning off the third switch transistor under control of the second scanning line, turning off the fourth switch transistor under control of the third scanning line to control the data line to input a data signal to the first pixel electrode and the second pixel electrode through the first switch transistor and the second switch transistor, thereby driving pixel structures where the first pixel electrode and the second pixel electrode are located to display;

turning on the third switch transistor under control of the second scanning line, turning off the first switch transistor and the second switch transistor under control of the first scanning line, turning off the fourth switch transistor under control of the third scanning line and establishing a preset voltage difference between the first pixel electrode and the second pixel electrode through the auxiliary electrode;

turning on the fourth switch transistor under control of the third scanning line, turning off the first switch transistor and the second switch transistor under control of the first scanning line, turning off the third switch transistor under control of the second scanning line to control the common voltage signal line to input a common voltage signal into the auxiliary electrode through the fourth switch transistor.

2. A driving device of a display panel, comprising:

a driver module configured to, in performing a plane display, turn on a first switch transistor and a second switch transistor under control of a first scanning line and turn off a third switch transistor under control of a second scanning line and turn off a fourth switch transistor under control of a third scanning line, such that a data line inputs a data signal into a first pixel electrode and a second pixel electrode through the first switch transistor and the second switch transistor, thereby driving pixel structures where the first pixel electrode and the second pixel electrode are located to display;

a voltage control module configured to turn on the third switch transistor under control of the second scanning line, and turn off the first switch transistor and the second switch transistor under control of the first scanning line, and turn off the fourth switch transistor under control of the third scanning line, such that a portion of the charge in the second pixel electrode is transferred to an auxiliary electrode, thereby establishing a preset voltage difference between the first pixel electrode and the second pixel electrode;

wherein the display panel comprises an array substrate, comprising:

a plurality of the data lines;

a plurality of the first scanning lines;

a plurality of the second scanning lines;

a plurality of the third scanning lines;

a plurality of common voltage signal lines;

a plurality of pixel units, wherein each of the pixel unit includes the first pixel electrode, the second pixel electrode, and the auxiliary electrode made of a same material;

a plurality of the first switch transistors disposed corresponding to the first pixel electrodes, wherein the control electrode of the first switch transistor is electrically connected to the first scanning line, and a first electrode of the first switch transistor is electrically connected to the data line, and a second electrode of the first switch transistor is electrically connected to a corresponding one of the first pixel electrodes;

a plurality of the second switch transistors disposed corresponding to the second pixel electrodes, wherein the control electrode of the second switch transistor is electrically connected to the first scanning line, and a first electrode of the second switch transistor is electrically connected to the data line that is electrically connected to the first switch transistor, and a second electrode of the second switch transistor is electrically connected to a corresponding one of the second pixel electrodes;

a plurality of the third switch transistors disposed corresponding to the auxiliary electrodes, wherein the control electrode of the third switch transistor is electrically connected to the second scanning line, and a first electrode of the third switch transistor is electrically connected to the second pixel electrode of a same one of the pixel units, and a second electrode of the third switch transistor is electrically connected to a corresponding one of the auxiliary electrodes; and a plurality of the fourth switch transistors, wherein the control electrode of the fourth switch transistor is electrically connected to the third scanning line, and a first electrode of the fourth switch transistor is electrically connected to the common voltage signal line, and a second electrode of the fourth switch transistor is electrically connected to the auxiliary electrode;

wherein projections of the second scanning line and the third switch transistor on a layer where the second pixel electrode and the auxiliary electrode are disposed are positioned between the second pixel electrode and the auxiliary electrode.

3. The driving device of claim 2, wherein the first pixel electrode, the second pixel electrode, and the auxiliary electrode are sequentially disposed along a direction in parallel to the data line.

4. The driving device of claim 2, wherein, in performing a three-dimensional display, the driver module is configured to turn on the first switch transistor and the second switch transistor under control of the first scanning line and turn off the third switch transistor under control of the second scanning line and turn off the fourth switch transistor under control of the third scanning line to control the data line to input a data signal into the first pixel electrode and the second pixel electrode through the first switch transistor and the second switch transistor, thereby driving pixel structures where the first pixel electrode and the second pixel electrode are located to display; wherein the voltage control module is configured to turn on the third switch transistor under control of the second scanning line and turn off the first switch transistor and the second switch transistor under control of the first scanning line, and turn off the fourth switch transistor under control of the third scanning line and establish a preset voltage difference between the first pixel electrode and the second pixel electrode through the auxiliary electrode; wherein the fourth switch transistor is turned on under control of the third scanning line, and the first switch transistor and the second switch transistor are turned off under control of the first scanning line, and the third switch transistor is turned off under control of the second scanning line to control the common voltage signal line to input a common voltage signal into the auxiliary electrode through the fourth switch transistor.

5. The driving device of claim 2, wherein the first switch transistor, the second switch transistor, the third switch transistor, and the fourth switch transistor are thin film transistors;

wherein the control electrode of the first switch transistor is a gate electrode of the thin film transistor, and the first electrode of the first switch transistor is a drain electrode of the thin film transistor, and the second electrode of the first switch transistor is a source electrode of the thin film transistor;

wherein the control electrode of the second switch transistor is a gate electrode of the thin film transistor, and the first electrode of the second switch transistor is a drain electrode of the thin film transistor, and the second electrode of the second switch transistor is a source electrode of the thin film transistor;

wherein the control electrode of the third switch transistor is a gate electrode of the thin film transistor, and the first electrode of the third switch transistor is a drain electrode of the thin film transistor, and the second electrode of the third switch transistor is a source electrode of the thin film transistor;

wherein the control electrode of the fourth switch transistor is a gate electrode of the thin film transistor, and the first electrode of the fourth switch transistor is a drain electrode of the thin film transistor, and the second electrode of the fourth switch transistor is a source electrode of the thin film transistor.

6. The driving device of claim 2, wherein the material that the first pixel electrode, the second pixel electrode, and the auxiliary electrode are made of includes indium tin oxide.

7. The driving device of claim 2, wherein each one of the first pixel electrode, the second pixel electrode, and the auxiliary electrode respectively connects in parallel to at least one capacitor disposed in a non-display area of the display panel.

8. The driving device of claim 2, wherein the display device further comprises a color-filter substrate disposed opposite to the array substrate.

9. A driving device of a display panel, comprising:

a driver module configured to, in performing a plane display, turn on a first switch transistor and a second switch transistor under control of a first scanning line and turn off a third switch transistor under control of a second scanning line, and turn off a fourth switch transistor under control of a third scanning line, such that a data line inputs a data signal into a first pixel electrode and a second pixel electrode through the first switch transistor and the second switch transistor, thereby driving pixel structures where the first pixel electrode and the second pixel electrode are located to display;

a voltage control module configured to turn on the third switch transistor under control of the second scanning line and turn off the first switch transistor and the second switch transistor under control of the first scanning line and turn off the fourth switch transistor under control of the third scanning line, such that a portion of the charge in the second pixel electrode is transferred to an auxiliary electrode, thereby establishing a preset voltage difference between the first pixel electrode and the second pixel electrode;

wherein the display panel comprises an array substrate, comprising:

a plurality of the data lines;

a plurality of the first scanning lines;

a plurality of the second scanning lines;

a plurality of the third scanning lines;

a plurality of common voltage signal lines;

a plurality of pixel units, wherein each of the pixel units includes the first pixel electrode, the second pixel electrode, and the auxiliary electrode made of a same material;

a plurality of the first switch transistors disposed corresponding to the first pixel electrodes, wherein the control electrode of the first switch transistor is electrically connected to the first scanning line, and a first electrode of the first switch transistor is electrically connected to the data line, and a second electrode of the first switch transistor is electrically connected to a corresponding one of the first pixel electrodes;

a plurality of the second switch transistors disposed corresponding to the second pixel electrodes, wherein the control electrode of the second switch transistor is electrically connected to the first scanning line, and a first electrode of the second switch transistor is electrically connected to the data line electrically connected by the first switch transistor, and a second electrode of the second switch transistor is electrically connected to a corresponding one of the second pixel electrodes;

a plurality of the third switch transistors disposed corresponding to the auxiliary electrodes, wherein the control electrode of the third switch transistor is electrically connected to the second scanning line, and a first electrode of the third switch transistor is electrically connected to the second pixel electrode of a same one of the pixel units, and a second electrode of the third switch transistor is electrically connected to a corresponding one of the auxiliary electrodes; and a plurality of the fourth switch transistors, wherein the control electrode of the fourth switch transistor is electrically connected to the third scanning line, and a first electrode of the fourth switch transistor is electrically connected to the common voltage signal line, and a second electrode of the fourth switch transistor is electrically connected to the auxiliary electrode;

wherein the first switch transistor, the second switch transistor, the third switch transistor, and the fourth switch transistor are thin film transistors;

wherein projections of the second scanning line and the third switch transistor on a layer where the second pixel electrode and the auxiliary electrode are disposed are positioned between the second pixel electrode and the auxiliary electrode.

10. The driving device of claim 9, wherein the first pixel electrode, the second pixel electrode, and the auxiliary electrode are sequentially disposed along a direction in parallel to the data line.

11. The driving device of claim 9, wherein, in performing a three dimensional display, the driver module is configured to turn on the first switch transistor and the second switch transistor under control of the first scanning line and turn off the third switch transistor under control of the second scanning line and turn off the fourth switch transistor under control of the third scanning line to control the data line to input a data signal into the first pixel electrode and the second pixel electrode through the first switch transistor and the second switch transistor, thereby driving pixel structures where the first pixel electrode and the second pixel electrode are located to display; wherein the voltage control module is configured to turn on the third switch transistor under control of the second scanning line and turn off the first switch transistor and the second switch transistor under control of the first scanning line and turn off the fourth switch transistor under control of the third scanning line and establish a preset voltage difference between the first pixel electrode and the second pixel electrode through the auxiliary electrode; wherein the fourth switch transistor is turned on under control of the third scanning line, and the first switch transistor and the second switch transistor are turned off under control of the first scanning line, and the third switch transistor is turned off under control of the second scanning line to control the common voltage signal line to input a common voltage signal into the auxiliary electrode through the fourth switch transistor.

12. The driving device of claim 9, wherein the first switch transistor, the second switch transistor, the third switch transistor, and the fourth switch transistor are thin film transistors;

wherein the control electrode of the first switch transistor is a gate electrode of the thin film transistor, and the first electrode of the first switch transistor is a drain electrode of the thin film transistor, and the second electrode of the first switch transistor is a source electrode of the thin film transistor; wherein the control electrode of the second switch transistor is a gate electrode of the thin film transistor, and the first electrode of the second switch transistor is a drain electrode of the thin film transistor, and the second electrode of the second switch transistor is a source electrode of the thin film transistor; wherein the control electrode of the third switch transistor is a gate electrode of the thin film transistor, and the first electrode of the third switch transistor is a drain electrode of the thin film transistor, and the second electrode of the third switch transistor is a source electrode of the thin film transistor; wherein the control electrode of the fourth switch transistor is a gate electrode of the thin film transistor, and the first electrode of the fourth switch transistor is a drain electrode of the thin film transistor, and the second electrode of the fourth switch transistor is a source electrode of the thin film transistor.

13. The driving device of claim 9, wherein the material that the first pixel electrode, the second pixel electrode, and the auxiliary electrode are made of includes indium tin oxide.

14. The driving device of claim 9, wherein each one of the first pixel electrode, the second pixel electrode, and the auxiliary electrode respectively connects in parallel to at least one capacitor disposed in a non-display area of the display panel.

15. The driving device of claim 9, wherein the display device further comprises a color-filter substrate disposed opposite to the array substrate.

* * * * *